US010190294B2

(12) United States Patent
Varma

(10) Patent No.: US 10,190,294 B2
(45) Date of Patent: Jan. 29, 2019

(54) SELF-ALIGNING LIFT KNOB FOR PLUMBING FIXTURE

(71) Applicant: Kohler Co., Kohler, WI (US)

(72) Inventor: Shashank Varma, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 10 days.

(21) Appl. No.: 15/451,953

(22) Filed: Mar. 7, 2017

(65) Prior Publication Data

US 2017/0268207 A1 Sep. 21, 2017

Related U.S. Application Data

(60) Provisional application No. 62/308,658, filed on Mar. 15, 2016.

(51) Int. Cl.
*E03C 1/04* (2006.01)

(52) U.S. Cl.
CPC ..... *E03C 1/0404* (2013.01); *E03C 1/04* (2013.01); *E03C 1/0412* (2013.01); *Y10T 137/9464* (2015.04)

(58) Field of Classification Search
USPC ..... 137/801
See application file for complete search history.

(56) References Cited

U.S. PATENT DOCUMENTS 1,429,637 A * 9/1922 Russell ..... F16K 31/52408 251/256
1,436,650 A * 11/1922 Gilbert ..... F16K 31/52408 137/523
2,236,109 A * 3/1941 Mueller ..... F16K 35/027 251/81
2,664,265 A * 12/1953 Howser ..... F16K 1/34 251/253
5,704,397 A * 1/1998 Lu ..... E03C 1/08 137/630.15
9,038,986 B2 * 5/2015 Hecht ..... F16K 7/12 251/175
9,995,023 B2 * 6/2018 Devries ..... E03C 1/0404
2009/0205128 A1 * 8/2009 Jones ..... E03C 1/0404 4/678
2016/0201304 A1 * 7/2016 Doss ..... E03C 1/023 137/15.01

* cited by examiner

*Primary Examiner* — Robert K Arundale
*Assistant Examiner* — Daphne M Barry
(74) *Attorney, Agent, or Firm* — Foley & Lardner LLP

(57) ABSTRACT

Various embodiments provide for a plumbing fixture comprising a spout. The spout comprises a body with a collar on a top surface of the body and a hole extending through the collar and defining an internal surface of the collar. The spout further comprises a first camming surface formed on the internal surface. The plumbing fixture further comprises a lift knob. The lift knob comprises a head. The head comprises a front side, top side, and a bottom side. The lift knob further comprises a shaft. The shaft is axially movable within the hole and has a first end and a second end. The first end is coupled to the bottom side of the head and the second end disposed within the spout. A second camming surface is formed on the bottom side of the head. The second camming surface has a geometrically complementary surface to the first camming surface.

20 Claims, 7 Drawing Sheets

SELF-ALIGNING LIFT KNOB FOR PLUMBING FIXTURE

CROSS-REFERENCE TO RELATED APPLICATION

This application claims the benefit of priority to U.S. patent application Ser. No. 62/308,658, filed Mar. 15, 2016, which is hereby incorporated by reference in its entirety.

BACKGROUND

This application relates generally to the field of plumbing fixtures such as faucets, tub spouts, and the like. More specifically, this application relates to lifting mechanisms for such plumbing fixtures that include features intended to maintain a desired orientation of the lifting mechanism.

SUMMARY

Various embodiments provide for a plumbing fixture comprising a spout. The spout comprises a body with a collar on a top surface of the body. The collar includes a hole extending through the collar and defines an internal surface of the collar. The spout further comprises a first camming surface formed on the internal surface. The plumbing fixture further comprises a lift knob. The lift knob comprises a head. The head comprises a front side, a top side, and a bottom side. The lift knob further comprises a shaft. The shaft is axially movable within the hole and has a first end and a second end. The first end is coupled to the bottom side of the head and the second end disposed within the spout. A second camming surface is formed on the bottom side of the head. The second camming surface has a geometrically complementary surface to the first camming surface. When the head of the lift knob engages the collar, the second camming surface engages and aligns with the first camming surface on the collar of the spout. The front side of the head rotates into a predetermined alignment with the body of the spout.

Various embodiments provide for a plumbing fixture comprising a collar with a hole extending through the collar. The hole defines an internal surface of the collar. The first camming surface is formed on the internal surface of the collar. The plumbing fixture further comprises a lift knob. The lift knob comprises a head. The head comprises a front side, a top side, and a bottom side. The lift knob further comprises a shaft. The shaft is axially movable within the hole and has a first end and a second end. The first end is coupled to the bottom side of the head and the second end disposed within the spout. A second camming surface is formed on the bottom side of the head. The second camming surface has a geometrically complementary surface to the first camming surface. When the head of the lift knob engages the collar, the second camming surface on the head engages and aligns with the first camming surface on the collar of the spout. The front side of the head rotates into a predetermined alignment.

Various embodiments provide for a lift knob comprising a head. The head comprises a front side, a top side, and a bottom side. The lift knob further comprises a shaft. The shaft is axially movable within the hole and has a first end and a second end. The first end is coupled to the bottom side of the head and the second end disposed within a spout. The lift knob further comprises a camming surface. The camming surface is formed on the bottom side of the head. The camming surface is structured to engage a geometrically complementary surface. When the camming surface engages the geometrically complementary surface, the front side of the head rotates into a predetermined alignment with the body of the spout.

DETAILED DESCRIPTION

Referring generally to the Figures, disclosed herein are various embodiments of a lift knob for a plumbing fixture such as a faucet or tub spout. The lift knob may be actuated by a user (e.g., raised and lowered) to close and open an associated drain in a sink or bathtub or a stopping mechanism within a spout. According to an exemplary embodiment, an underside (e.g., bottom) of the lift knob includes a camming surface that is configured to engage with a complementary camming surface included as part of an associated spout of a faucet or tub spout.

One issue associated with conventional lift knobs is that the rotational orientation of the lift knobs relative to the spout with which they are associated is relatively unconstrained. For example, a lift knob may have a particular shape or design that is most aesthetically pleasing when it is oriented in a particular manner relative to the rest of the spout. Because the lift knob may rotate as a user lifts it to close an associated drain, if the lift knob falls straight back down into place from the raised position, the orientation of the lift knob relative to the spout may not be as aesthetically pleasing as it was intended to be. A user would then need to manually move or twist the lift knob in its seated position to return it to a proper or preferred orientation.

It would be advantageous to provide a lift knob that returns to the same position each time the lift knob returns to its rest position so as to maintain the desired aesthetic for the faucet or tub spout. The exemplary embodiments described herein address this issue by providing a self-aligning (or so-called "self-clocking") lift knob. The self-aligning function being achieved through a geometrically complementary lift knob and camming surface, such that the geometry ensures that the lift knob returns to the same resting position every time.

Figure 1:
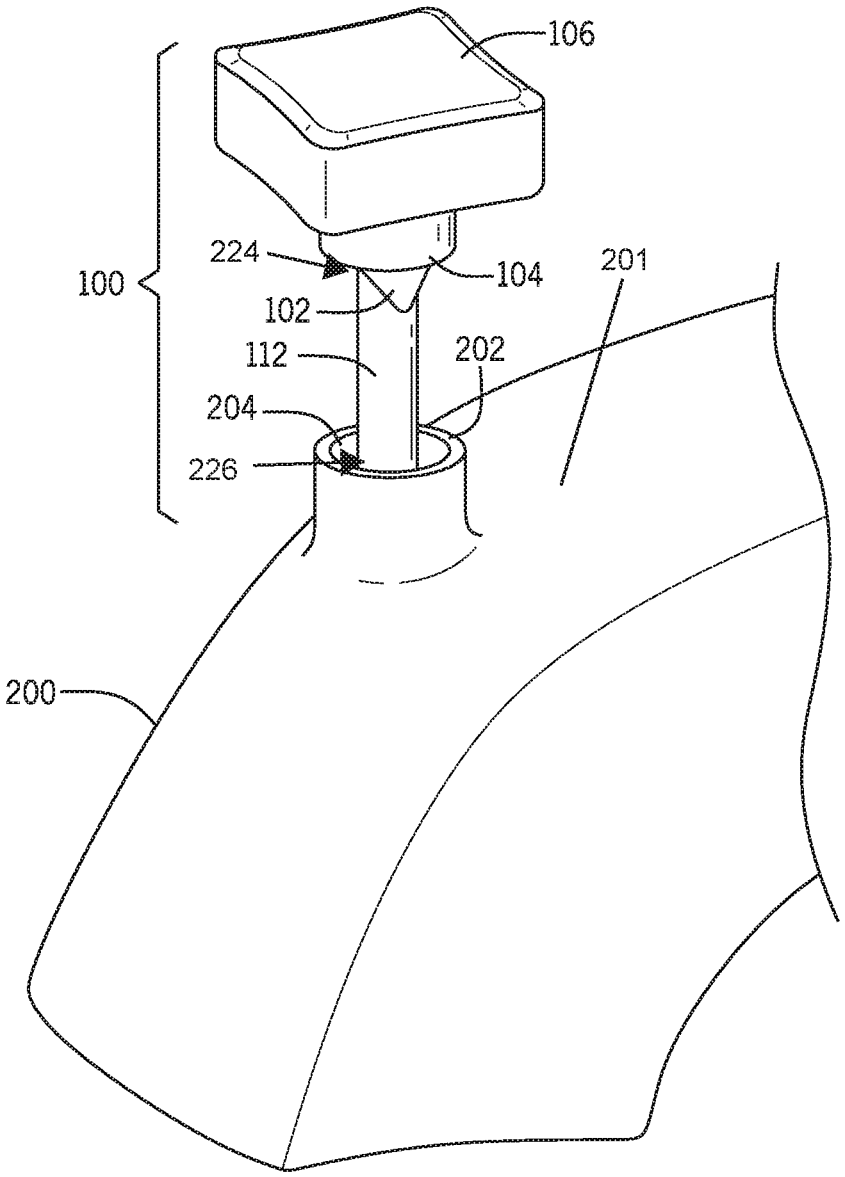
FIG. 1 is a top, right side perspective view of an exemplary embodiment of a lift knob inserted into a complementary camming surface formed on an internal surface of a collar on a tub spout.

FIG. 1 illustrates one non-limiting example of a top, right side perspective view of an exemplary embodiment of a lift knob 100 and associated tub spout 200 (although it should be understood by those reviewing the present disclosure that such a lift knob may also be used in conjunction with faucet applications in which the lift knob is provided as part of a faucet, either on the spout or at another location of the faucet). As shown in FIG. 1, the lift knob 100 is in the raised position relative to the tub spout 200 to illustrate the complementary camming surface 204 formed on an internal surface of a collar 202 on the top surface of a body of a tub spout 200 (see also FIG. 4). As will be appreciated, the lift knob 100 is axially movable through the collar 202 and actuates a stopping mechanism (not shown for clarity). The stopping mechanism permits and blocks the passage of flow in the spout and/or of a drain associated with the plumbing fixture. In some arrangements, the stopping mechanism is open (e.g., permits fluid flow) when the lift knob 100 is in the raised position relative to the tub spout 200. Conversely, the stopping mechanism is closed (e.g., blocks fluid flow) when the lift knob 100 is in the lowered position relative to the tub spout 200.

Figure 2A:
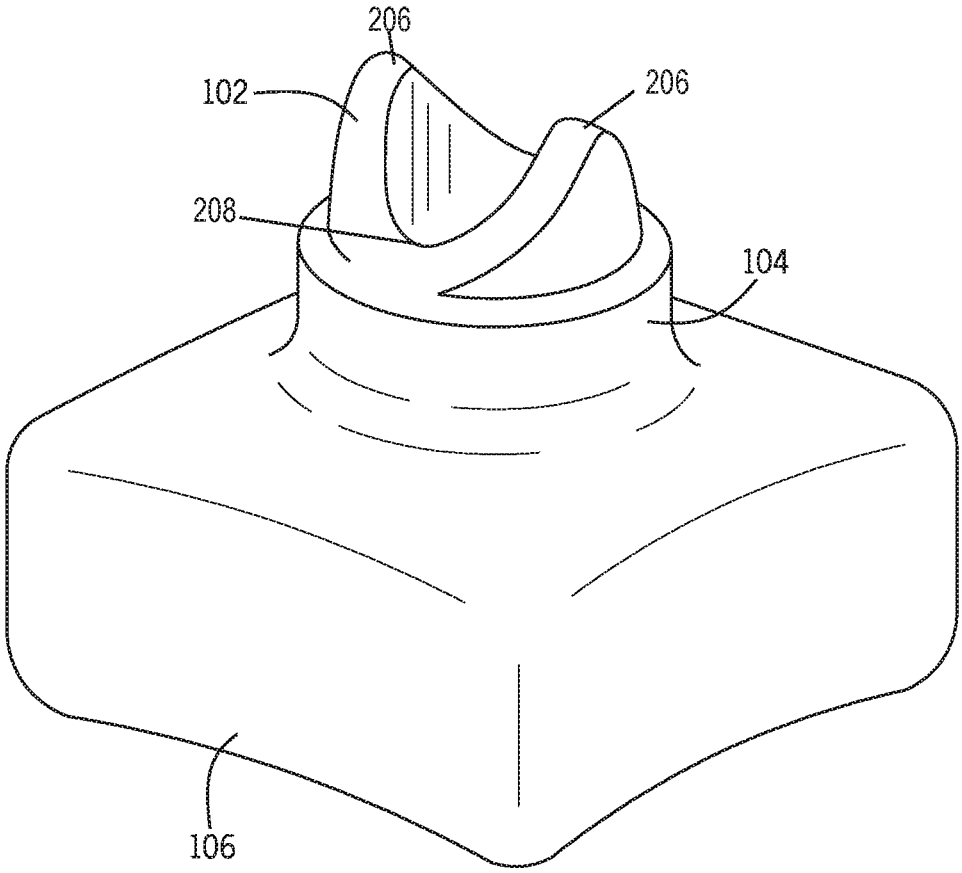
FIG. 2A is a bottom perspective view of an exemplary embodiment of the lift knob on a tub spout.

As illustrated in FIGS. 1 and 2A, the lift knob 100 includes a lift knob camming surface 102, a neck (e.g., base) 104, a head 106, and a shaft 112. The head 106 of the lift knob is not limited to the curved square shaped as shown in FIGS. 1-3 and includes any design feature or aesthetic configuration. In some embodiments, the head includes a front side, a back side, a top side, a bottom side. The front side of the head 106 may be the desired side (e.g., for aesthetic purposes) to be shown for the predetermined alignment with the body 201 of the spout through the self-aligning features of the camming surfaces 102, 204. As will be appreciated, the term "predetermined alignment" describes the orientation of the front side of the head 106 with respect to the body of the spout when the camming surface of the collar 204, such that the geometry of the camming surfaces ensures that the front side of the head 106 returns to the same resting position (e.g., aligned position) every time. A cylindrical neck 104 is formed around the bottom side of the head 106. The bottom side of the head is coupled to a first end 224 of the shaft 112. As shown in FIG. 1, a second end 226 of the shaft 112 of the lift knob 100 is disposed in a hole 220 that extends through the collar 202 located on the top surface of the tub spout 200. The shaft 112 of the lift knob is axially movable within the hole 220. In some embodiments, the neck 104 has a greater diameter than the collar 202 formed on the top surface of the tub spout 200, such that the neck 104 acts as a stopping mechanism for the shaft 112 axially movement into the hole 220.

Turning to the self-aligning features of the camming surfaces 102, 204, the geometries of the lift knob camming surface 102 of the lift knob 100 and the collar camming surface 204 formed on the internal surface 222 of the collar 202 on the top surface of the body 201 of the tub spout are complementary. Thus, the geometries of these two complementary features are configured such that as the lift knob 100 descends from a raised position to a resting position, the lift knob camming surface 102 comes into contact with the collar camming surface 204 formed on the internal surface 222 of the collar 202. Upon contact, the lift knob 100 slides and rotates into the same resting position every time so that the head 106 of the lift knob 100 is orientated in an aesthetically preferred position. For example, according to the exemplary embodiment shown in the accompanying figures in which the head 106 has a generally square shape, the complementary geometric shapes of the camming surfaces 102, 204 act to ensure that, in the resting position, the sides of the square head are parallel to the sides of the spout 200. Of course, according to other exemplary embodiments, the head may have any of a variety of different shapes, sizes, and configurations, and the complementary camming surfaces may be used to ensure that the head is rotated into its preferred position regardless of the specific geometry of the head. For example, the complementary geometric shapes of the camming surfaces 102, 204 may be disposed such that the lift knob 100 self-aligns so that either a front side of the head 106 or a back side of the head 106 is facing forward relative to the tub spout 200.

As shown in FIG. 1, the lift knob camming surface 102 comprises two opposite peaks 206 and two opposite valleys 208, while the collar camming surface 204 comprises two opposite peaks 210 and two opposite valleys 212 rotated forty five degrees in relation to the pair of peaks 206 and valleys 208 on the lift knob camming surface 102. While FIG. 1 shows a generally crescent shaped lift knob camming surface 102 and complementary collar camming surface 204, the geometry of the camming surfaces 102, 204 can be any similar complementary geometric shapes that performs the same function. In other arrangements, the collar camming surface 204 may be a raised region and the lift knob camming surface 102 may be a depressed region (e.g., opposite to what is illustrated in the accompanying drawing figures). For example, the lift knob camming surface 102 each may be a hollow cylindrical projection having an inner end surface formed into one or more depressed geometric pattern(s) and the collar camming surface 204 may be a hollow cylindrical projection having an outer end surface formed into one or more raised geometric pattern(s). The raised and depressed regions of the lift knob camming surface 102 and the collar camming surface 204 can be in any configuration or combination, as long as the respective geometries are complementary so that the lift knob 100 slides and rotates into the same rest position every time, without the need for subsequent user adjustment.

FIG. 2A illustrates a bottom perspective view of a portion of the lift knob 100 shown in FIG. 1 (i.e., with the shaft 112 removed). The lift knob 100, as shown in FIG. 2A, includes the lift knob camming surface 102 having a geometric shape that complements the shape of the collar camming surface 204. The lift knob camming surface 102 comprises a pair of peaks 206 and a pair of valleys 208. The neck 104 of the lift knob 100 can be any shape or dimension that complements the overall intended design feature of the lift knob 100 and the head 106, and may also advantageously act as a stop for the lift knob that engages a complementary feature of the spout or other structure to which the lift knob is attached.

Figure 2B:
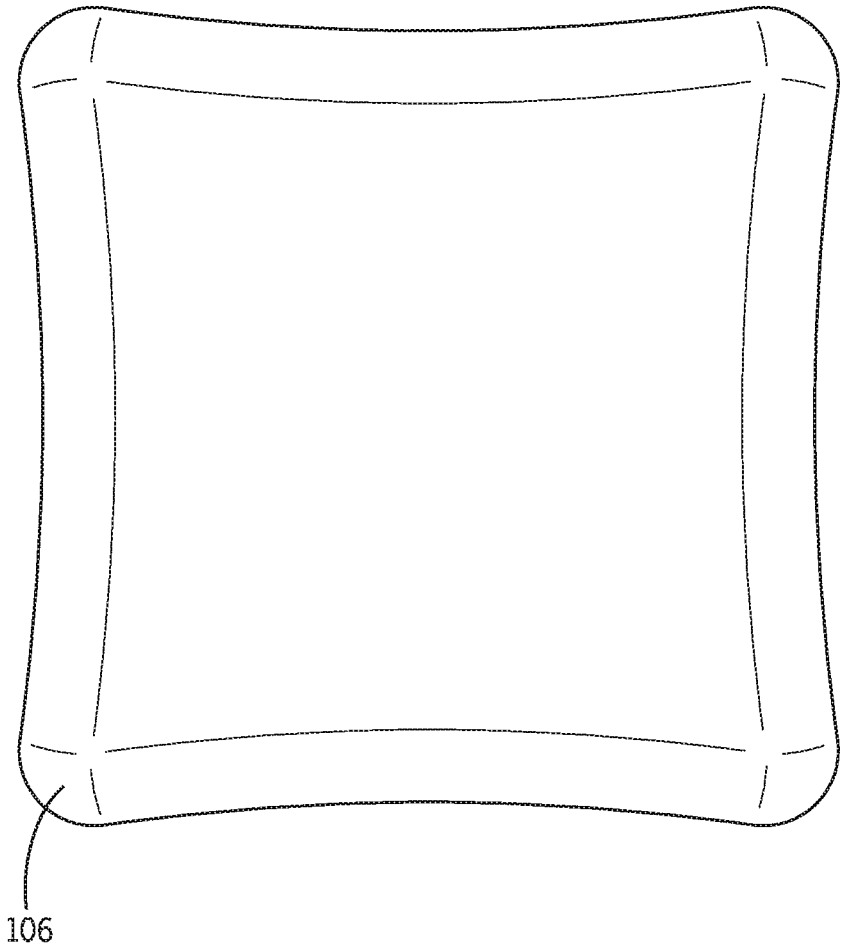
FIG. 2B is a top plan view of an exemplary embodiment of the lift knob on a tub spout.
Figure 3:
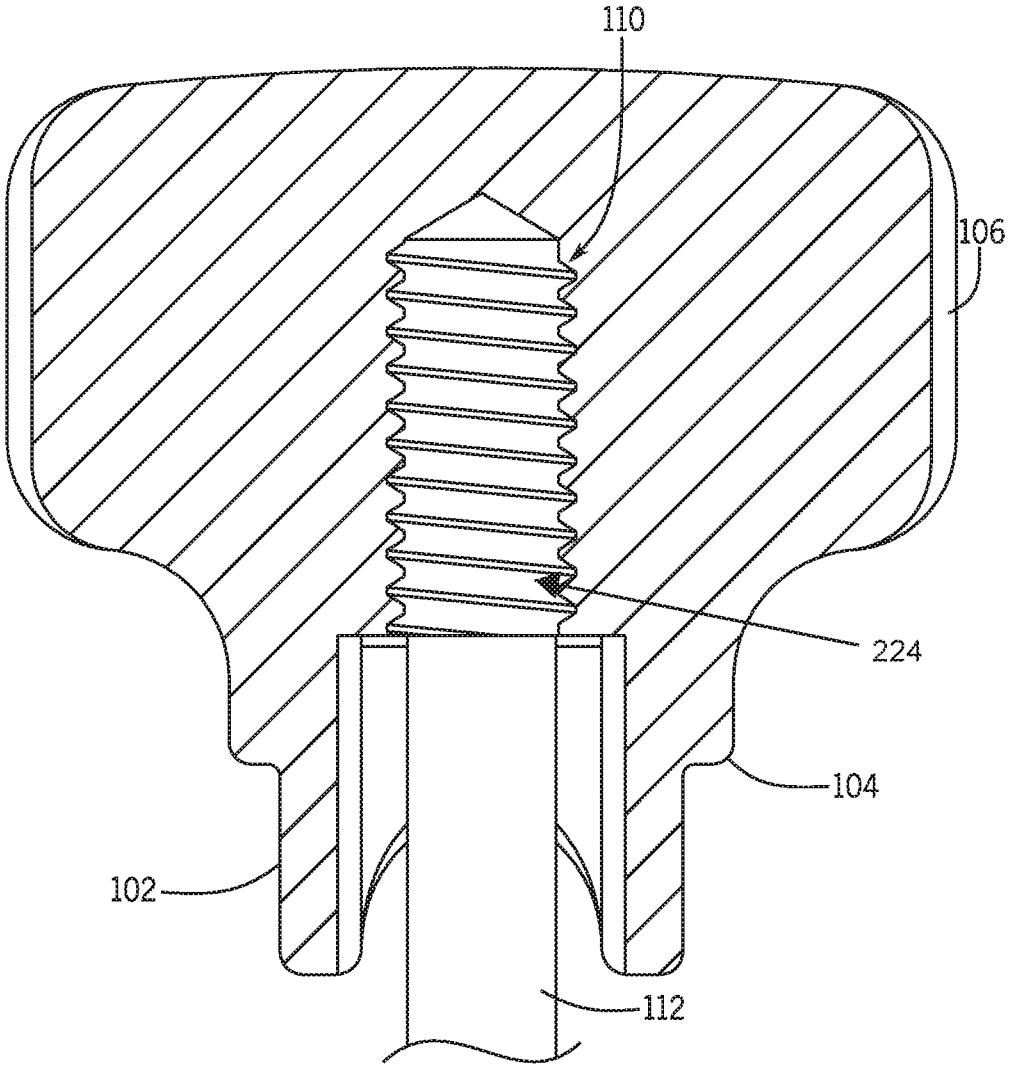
FIG. 3 is a front plan cross-sectional view of an exemplary embodiment of the lift knob on a tub spout.

FIG. 2B is a non-limiting example of a top plan view of the lift knob 100. The shape of the head 106 is not limited to the curved square shaped as shown in FIG. 2B, as it can embody any shape that accomplishes the intended overall design feature or aesthetics of the lift knob 100.

Figure 2C:
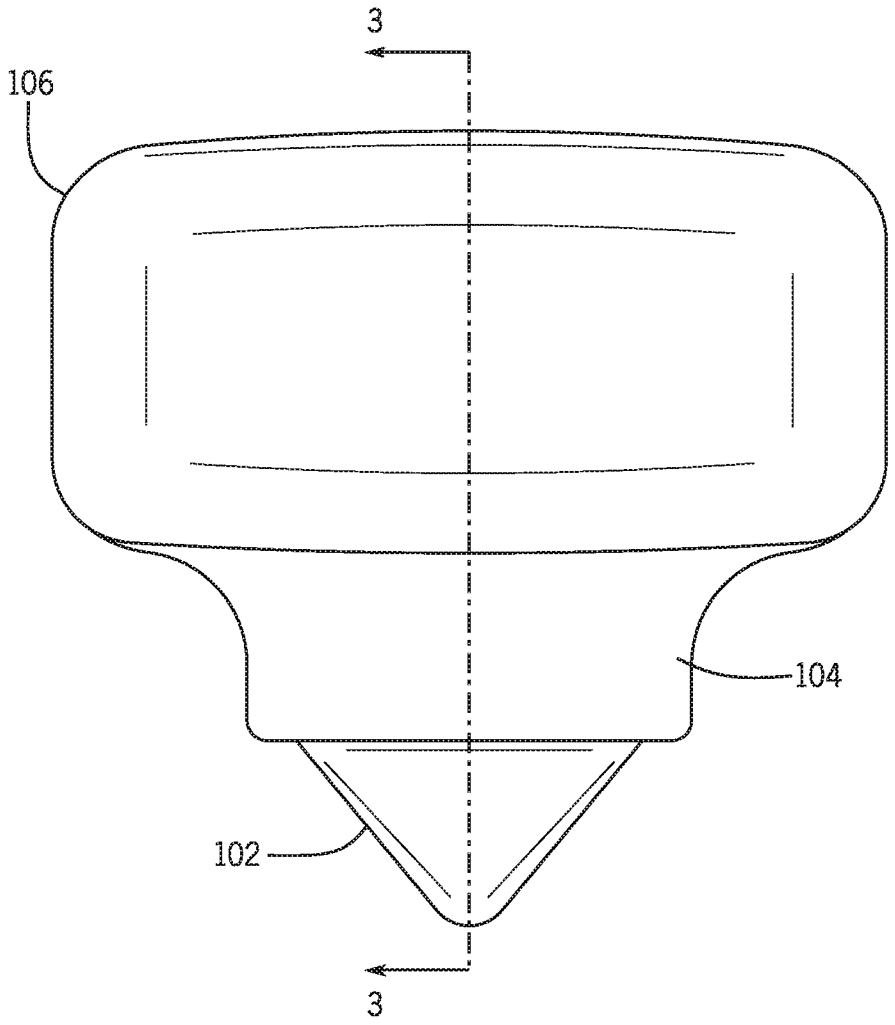
FIG. 2C is a left side elevation view of an exemplary embodiment of the lift knob on a tub spout.

FIG. 2C is a non-limiting example of a left side elevation view of the lift knob 100. The lift knob 100, as shown, includes the lift knob camming surface 102 in a crescent geometric shape, the neck 104, and the head 106.

Figure 2D:
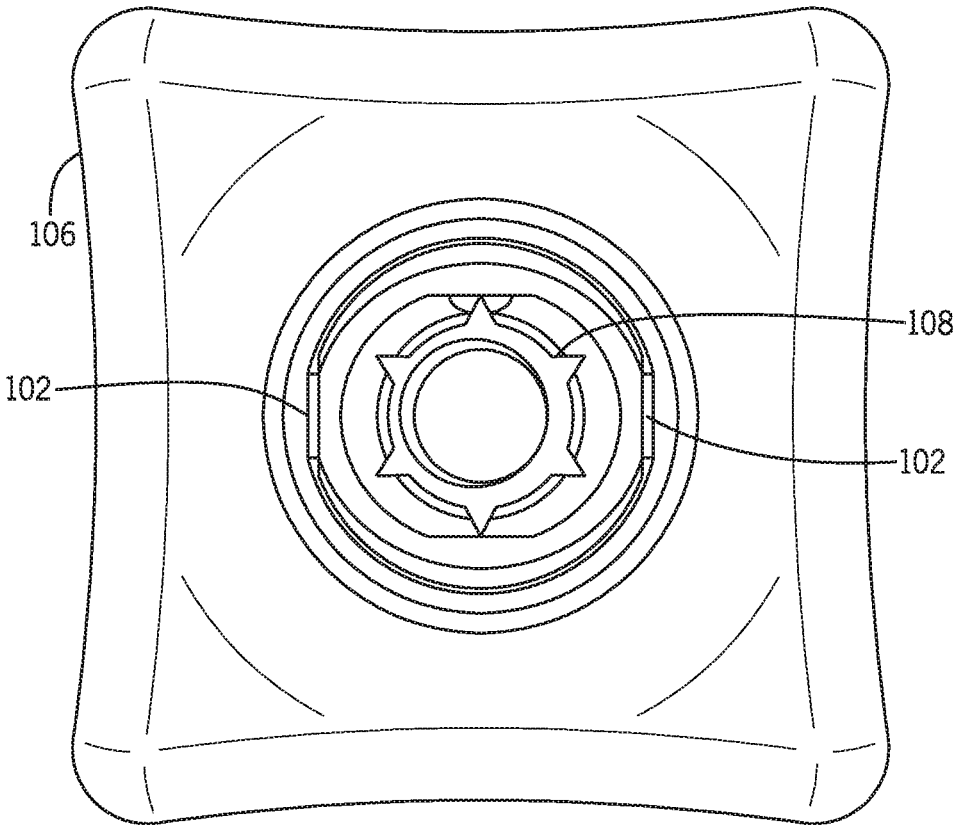
FIG. 2D is a bottom plan view of an exemplary embodiment of the lift knob on a tub spout.

FIG. 2D is a non-limiting example of a bottom plan view of the lift knob 100. The lift knob 100, as shown, includes the lift knob camming surface 102 in a crescent geometric shape, the head 106, and a screw thread 108 for the lift knob shaft 112 (not shown) to be inserted. In some embodiments, the screw thread 108 is affixed or molded onto the lift knob shaft 112 such that the lift knob 100 and shaft 112 are a single unit.

FIG. 3 is a non-limiting example of a front plan cross-sectional view of the lift knob 100. The lift knob 100, as shown, includes the lift knob camming surface 102 in a crescent geometric shape, the head 106, and a screw thread 110 attached to the lift knob shaft 112. In some arrangements, the lift knob shaft 112 could be permanently affixed to the lift knob 100, for example, using a molding technique to make the lift knob head 106, neck 104, lift knob camming surface 102, and shaft 112 all one piece.

Figure 4:
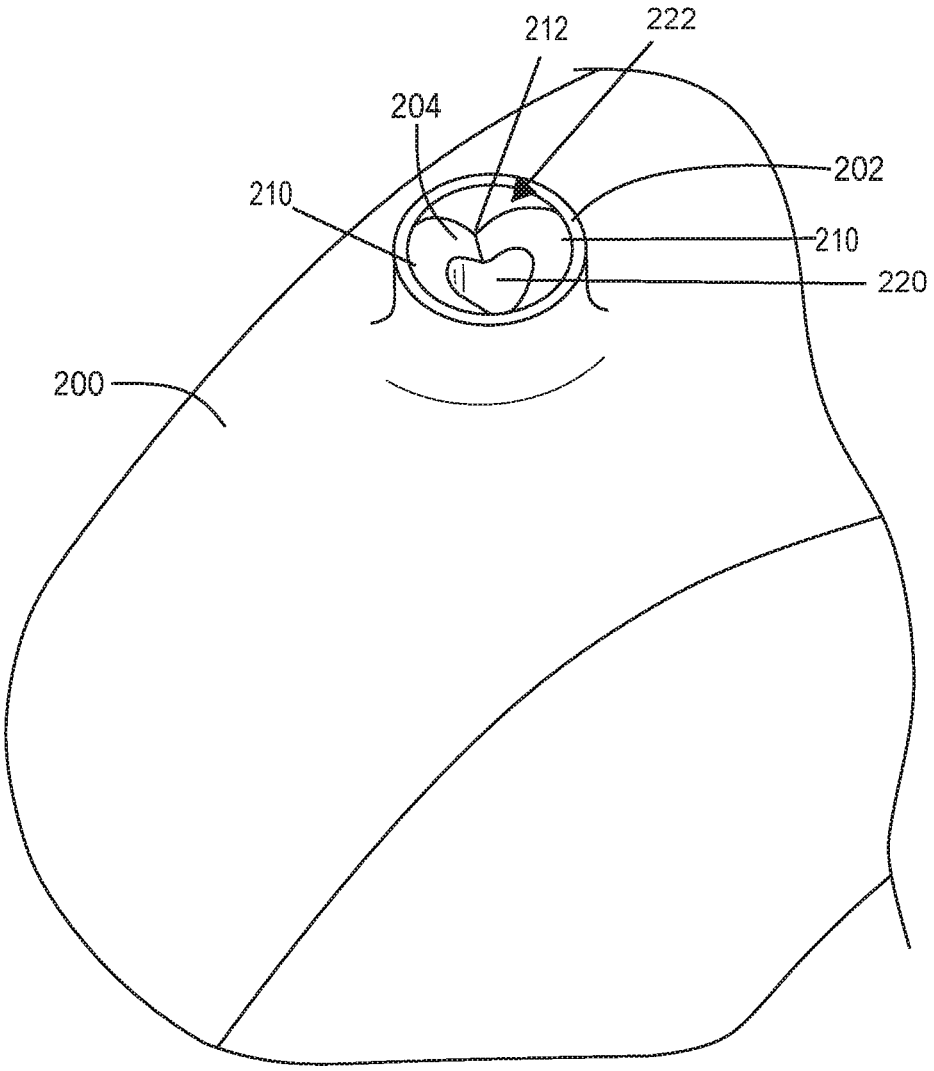
FIG. 4 is a perspective view of an exemplary embodiment of the tub spout and the camming surface for the lift knob.

FIG. 4 is a non-limiting example of a perspective view of an exemplary embodiment of the tub spout 200 and the collar camming surface 204 as shown in FIG. 1. The collar camming surface 204 contains a depressed region that is geometrically orientated to be complementary to the lift knob camming surface 102 of the lift knob. Specifically, the collar camming surface 204 comprises a pair of peaks 210 and a pair of valleys 212. When the lift knob is released from the raised position and descends into the hole 220 extending through the collar to the rest position, the lift knob camming surface 102 of the lift knob comes into contact with the collar camming surface 204. Once in contact with the collar camming surface 204, the lift knob may be automatically rotated so that the head 106 is aligned in the desired orientation. The collar 202 for the collar camming surface 204 may be located throughout the tub spout 200. In some embodiments, the tub spout 200 may contain multiple holes 220, multiple collars 202, and camming surfaces 204.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the bathtub spout lift knob and complementary camming surface as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., the lift knob, the tub spout, the camming surface, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A plumbing fixture, comprising:

a spout, the spout comprising:

a body, with a collar on a top surface of the body, and a hole extending through the collar and defining an internal surface of the collar; and a first camming surface formed on the internal surface; and a lift knob, the lift knob comprising:

a head, the head comprising a front side, a top side, and a bottom side;

a shaft, the shaft axially movable within the hole and having a first end and a second end, the first end coupled to the bottom side of the head, the second end disposed within the spout; and a second camming surface formed on the bottom side of the head, the second camming surface having a geometrically complementary surface to the first camming surface;

the shaft having a first position wherein the second camming surface is spaced from the first camming surface, such that when the shaft moves axially downward toward a second position, the movement causes the head of the lift knob to engage the collar and the second camming surface engages and aligns with the first camming surface to rotate the front side of the head into an aligned position with respect to the collar.

2. The plumbing fixture of claim 1, wherein the lift knob further comprises:

a neck, the neck having a first end and a second end, the first end of the neck formed on the bottom side of the head, wherein the second camming surface is formed on the second end of the neck.

3. The plumbing fixture of claim 2, wherein the neck includes a neck diameter and the collar includes a collar diameter, and wherein the neck diameter is greater than the collar diameter.

4. The plumbing fixture of claim 1, wherein the first end of the shaft is formed as a single unit with the bottom side of the head.

5. The plumbing fixture of claim 1, wherein the first end of the shaft comprises a first thread and the bottom side of the head comprises a second thread, and wherein the second thread engages with the first thread to removably couple the shaft and the head.

6. The plumbing fixture of claim 1, wherein the head further comprises a back side opposite the front side of the head, wherein when the second camming surface on the head engages and aligns with the first camming surface on the collar of the spout, either the back side of the head or the front side of the head is rotated into the aligned position with respect to the body of the spout.

7. The plumbing fixture of claim 1, wherein the first camming surface comprises a first hollow cylindrical projection having an inner end surface formed into a first plurality of alternating peaks and valleys, and wherein the second camming surface comprises a second hollow cylindrical projection having an outer end surface formed into a second plurality of alternating peaks and valleys, and wherein the first plurality of alternating peaks and valleys is complementary to the second plurality of alternating peaks and valleys.

8. A plumbing fixture, comprising:

a collar with a hole extending through the collar, the hole defining an internal surface of the collar and a first camming surface formed on the internal surface of the collar; and a lift knob, the lift knob comprising:

a head, the head comprising a front side, a top side, and a bottom side;

a shaft, the shaft axially movable within the hole and having a first end and a second end, the first end coupled to the bottom side of the head, the second end disposed within the hole of the collar; and a second camming surface formed on the bottom side of the head, the second camming surface having a geometrically complementary surface to the first camming surface;

the shaft having a first position wherein the second camming surface is spaced from the first camming surface, such that when the shaft moves axially downward toward a second position, the movement causes the head of the lift knob to engage the collar and the second camming surface engages and aligns with the first camming surface to rotate the front side of the head into an aligned position with respect to the collar.

9. The plumbing fixture of claim 8, wherein the lift knob further comprises:

a neck, the neck having a first end and a second end, the first end of the neck formed on the bottom side of the head, wherein the second camming surface is formed on the second end of the neck.

10. The plumbing fixture of claim 9, wherein the first camming surface includes a first camming surface diameter and the neck includes a neck diameter, and wherein the neck diameter is greater than the first camming surface diameter.

11. The plumbing fixture of claim 8, wherein the first end of the shaft is formed as a single unit with the bottom side of the head.

12. The plumbing fixture of claim 8, wherein the first end of the shaft comprises a first thread and the bottom side of the head comprises a second thread, and wherein the second thread engages with the first thread to removably couple the shaft and the head.

13. The plumbing fixture of claim 8, wherein the head further comprises a back side opposite the front side of the head, wherein when the second camming surface on the head engages and aligns with the first camming surface on the collar of a spout, either the back side of the head or the front side of the head is rotated into the aligned position with respect to a body of the spout.

14. The plumbing fixture of claim 8, wherein the first camming surface is a female camming surface and the second camming surface is a male camming surface.

15. The plumbing fixture of claim 8, wherein the first camming surface comprises a first hollow cylindrical projection having an inner end surface formed into a first peak and a first valley, and wherein the second camming surface comprises a second hollow cylindrical projection having an outer end surface formed into a second peak and a second valley, and wherein the first peak is geometrically complementary to the second valley and the second peak is geometrically complementary to the first valley.

16. A lift knob, comprising:

a head, the head comprising a front side, a top side, and a bottom side;

a shaft, the shaft axially movable within a hole and having a first end and a second end, the first end coupled to the bottom side of the head, the second end disposed within a spout; and a first camming surface formed on the bottom side of the head, the first camming surface structured to engage a geometrically complementary surface of a second camming surface formed on an internal surface of a body of the spout, the shaft having a first position and a second position, wherein in the first position the first camming surface is spaced away from the second camming surface and in the second position the first camming surface is in contact with the second camming surface, and wherein the shaft disengages from the first position causing the front side of the head rotates into an aligned position with respect to the body of the spout and the shaft is in the second position.

17. The lift knob of claim 16, wherein the first camming surface comprises a hollow cylindrical projection having an outer end surface formed into a peak and a valley, and wherein the peak and valley have complementary features formed in the geometrically complementary surface that engages the first camming surface.

18. The lift knob of claim 16, wherein the head further comprises a back side opposite the front side of the head, wherein when the first camming surface engages the geometrically complementary surface either the back side of the head or the front side of the head rotates into the aligned position with respect to the body of the spout.

19. The lift knob of claim 16, wherein the first end of the shaft is formed as a single unit with the bottom side of the head.

20. The lift knob of claim 16, wherein the first end of the shaft comprises a first thread and the bottom side of the head comprises a second thread, and wherein the second thread engages with the first thread to removably couple the shaft and the head.

* * * * *